US010330356B2

(12) United States Patent
Numasawa

(10) Patent No.: US 10,330,356 B2
(45) Date of Patent: Jun. 25, 2019

(54) LIQUID RECEIVER AND CONDENSER USING THE SAME

(71) Applicant: KEIHIN THERMAL TECHNOLOGY CORPORATION, Oyama-shi (JP)

(72) Inventor: Makoto Numasawa, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 0 days.

(21) Appl. No.: 15/829,988

(22) Filed: Dec. 4, 2017

(65) Prior Publication Data

US 2018/0164006 A1 Jun. 14, 2018

(30) Foreign Application Priority Data

Dec. 14, 2016 (JP) ..... 2016-241869

(51) Int. Cl.

| | |
|---|---|
| ***F25B 39/04*** | (2006.01) |
| ***F25B 43/00*** | (2006.01) |
| *F28F 9/02* | (2006.01) |
| *F28D 1/053* | (2006.01) |
| *F28D 21/00* | (2006.01) |

(52) U.S. Cl.

CPC ..... *F25B 39/04* (2013.01); *F25B 43/006* (2013.01); *F25B 2339/044* (2013.01); *F25B 2339/0441* (2013.01); *F25B 2339/0444* (2013.01); *F28D 1/05391* (2013.01); *F28D 2021/0084* (2013.01);

(Continued)

(58) Field of Classification Search

CPC .. F28F 1/126; F28F 9/026; F28F 9/028; F28F 9/0265; F28F 27/02; F28F 9/02; F28F 2220/00; F28F 2230/00; F28D 1/05316; F28D 1/05341; F28D 1/05366; F28D 1/05391; F28D 2021/0091; F28D 2021/0084; F25B 39/04; F25B 2339/0441;

(Continued)

(56) References Cited

U.S. PATENT DOCUMENTS 6,981,389 B2 * 1/2006 Knecht ..... F25B 43/003 62/474
9,464,850 B2 * 10/2016 Iino ..... F28D 1/05375

(Continued)

FOREIGN PATENT DOCUMENTS

JP 2015-028394 2/2015

*Primary Examiner* — Keith M Raymond
*Assistant Examiner* — Kamran Tavakoldavani
(74) *Attorney, Agent, or Firm* — Mori & Ward, LLP

(57) ABSTRACT

A liquid receiver is composed of a tubular base member having open upper and lower ends, a tubular tank member having a closed upper end and an open lower end and joined to the base member, and a plug fitted into the base member. A female screw is provided on the inner circumferential surface of the base member, and refrigerant inflow and outflow holes are formed in a portion of the base member above the female screw such that the former is located above the latter. A male screw to be screwed into the female screw is provided on the outer circumferential surface of the plug to be located below the refrigerant outflow hole. Sealing is established between a portion of the inner circumferential surface of the base member located below the female screw and a portion of the outer circumferential surface of the plug located below the male screw.

8 Claims, 4 Drawing Sheets

(52) U.S. Cl.
CPC ..... *F28F 9/02* (2013.01); *F28F 2220/00* (2013.01); *F28F 2230/00* (2013.01)

(58) Field of Classification Search
CPC ..... F25B 2339/0446; F25B 2339/044; F25B 2339/0445; F25B 40/02
See application file for complete search history.

(56) References Cited

U.S. PATENT DOCUMENTS

| | | | | |
|---|---|---|---|---|
| 2011/0247792 | A1* | 10/2011 | Chikuma | B23K 1/0012 165/173 |
| 2011/0253353 | A1* | 10/2011 | Tokizaki | F25B 39/04 165/173 |
| 2014/0014296 | A1* | 1/2014 | Arino | F28F 27/02 165/96 |

* cited by examiner

LIQUID RECEIVER AND CONDENSER USING THE SAME

BACKGROUND OF THE INVENTION

The present invention relates to a liquid receiver used in a car air conditioner which is a refrigeration cycle mounted on, for example, an automobile. The liquid receiver separates gas-liquid-mixed-phase refrigerant into gas-phase refrigerant and liquid-phase refrigerant. The present invention also relates to a condenser in which such a liquid receiver is used.

Herein, the term "liquid-phase refrigerant" encompasses liquid-phase predominant mixed-phase refrigerant containing a small amount of gas-phase refrigerant.

There has been known a condenser of a car air conditioner which includes a condensation section, a supercooling section provided below the condensation section, and a liquid receiver provided between the condensation section and the supercooling section. The liquid receiver is composed of a tubular body whose longitudinal direction coincides with the vertical direction and which is closed at the upper and lower ends thereof. Refrigerant flowing out of the condensation section flows into the supercooling section through the liquid receiver. Specifically, gas-liquid-mixed-phase refrigerant flowing out of the condensation section into the liquid receiver is separated into gas-phase refrigerant and liquid-phase refrigerant in the liquid receiver, and the liquid-phase refrigerant flows into the supercooling section.

A liquid receiver for use in a condenser of the above-described type has been proposed (see Japanese Patent Application Laid-Open (kokai) No. 2015-28394). The proposed liquid receiver includes a tubular female screw forming portion whose axial direction coincides with the vertical direction and which has a female screw formed on an upper portion of the inner circumferential surface thereof; a tubular body portion whose lower end portion is joined to the female screw forming portion such that the longitudinal direction of the body portion coincides with the vertical direction and which is closed at the upper end and is open at the lower end; and a columnar cap which is inserted into the female screw forming portion, which has a male screw for threading engagement with the female screw. The female screw forming portion has an insertion portion which is inserted into the body portion and is joined to the inner circumferential surface of the body portion and an uninserted portion disposed outside the body portion. The female screw is provided on the uninserted portion, the body portion has a refrigerant inflow hole through which refrigerant flows from the condensation section of the condenser into the body portion, and the female screw forming portion has a refrigerant outflow hole through which refrigerant flows out to the supercooling section of the condenser. A seal means is provided so as to establish sealing between a region of the inner circumferential surface of the female screw forming portion, which region is located below the female screw, and a region of the outer circumferential surface of the cap, which region is located below the male screw.

However, the liquid receiver disclosed in the publication has the following problem. Specifically, the refrigerant inflow hole through which refrigerant flows from the condensation section of the condenser into the body portion is formed in the body portion, and the refrigerant outflow hole through which refrigerant flows out to the supercooling section of the condenser is formed in the female screw forming portion, so that the distance in the vertical direction from the lower end of the liquid receiver to the upper end of the refrigerant inflow hole is relatively long. Therefore, when a refrigerating cycle which includes a condenser having such a liquid receiver is charged with refrigerant, a relatively long time is needed to fill a portion of the internal space of the liquid receiver located below the refrigerant inflow hole with liquid-phase refrigerant. In addition, in the case where the amount of refrigerant charge is constant, the width of a stable range within which the degree of supercooling becomes constant becomes relatively narrow.

SUMMARY OF THE INVENTION

In view of the above-described problem, an object of the present invention is to provide a liquid receiver which allows a refrigerating cycle to be charged with a proper amount of refrigerant in an early stage and which can widen a stable region within which the degree of supercooling is constant. Another object of the present invention is to provide a condenser in which the liquid receiver is used.

A liquid receiver according to the present invention is adapted to receive gas-liquid-mixed-phase refrigerant flowing from a condensation section of a condenser and separate the gas-liquid-mixed-phase refrigerant into gas-phase refrigerant and liquid-phase refrigerant. The liquid receiver comprises a base member joined to a tubular header tank of a condenser, a tank member, and a plug. The base member has a tubular shape, has a longitudinal direction, and is open at a first end on one side in the longitudinal direction and at a second end on the other side in the longitudinal direction. The tank member has a tubular shape, has a longitudinal direction coinciding with the longitudinal direction of the base member, is open at a first end on one side in the longitudinal direction of the tank member, and is closed at a second end on the other side in the longitudinal direction of the tank member. The first end of the tank member is fixed to the second end of the base member. The plug has a longitudinal direction coinciding with the longitudinal direction of the base member and is removably fitted into the base member from the first end side of the base member. The plug has a first end on the first end side of the base member and a second end on the second end side of the base member. A female screw is provided in a region of an inner circumferential surface of the base member, the region being located between the first end and the second end of the base member. A refrigerant inflow hole and a refrigerant outflow hole are formed in a portion of the base member, which portion is located on the second end side with respect to the female screw, to be separated from each other such that the refrigerant inflow hole is located on the second end side and the refrigerant outflow hole is located on the first end side. A male screw is provided in a longitudinally intermediate region of an outer circumferential surface of the plug to be located on the first end side with respect to the refrigerant outflow hole. The male screw is screwed into the female screw of the base member. At a portion of the base member on the first end side with respect to the female screw, a seal member is provided so as to establish sealing between the inner circumferential surface of the base member and the outer circumferential surface of the plug.

DESCRIPTION OF THE PREFERRED EMBODIMENT

An embodiment of the present invention will next be described with reference to the drawings.

In the following description, the upper side, lower side, left-hand side, and right-hand side of FIG. 1 will be referred to as "upper," "lower," "left," and "right," respectively.

In the following description, the term "aluminum" encompasses aluminum alloys in addition to pure aluminum.

Figure 1:
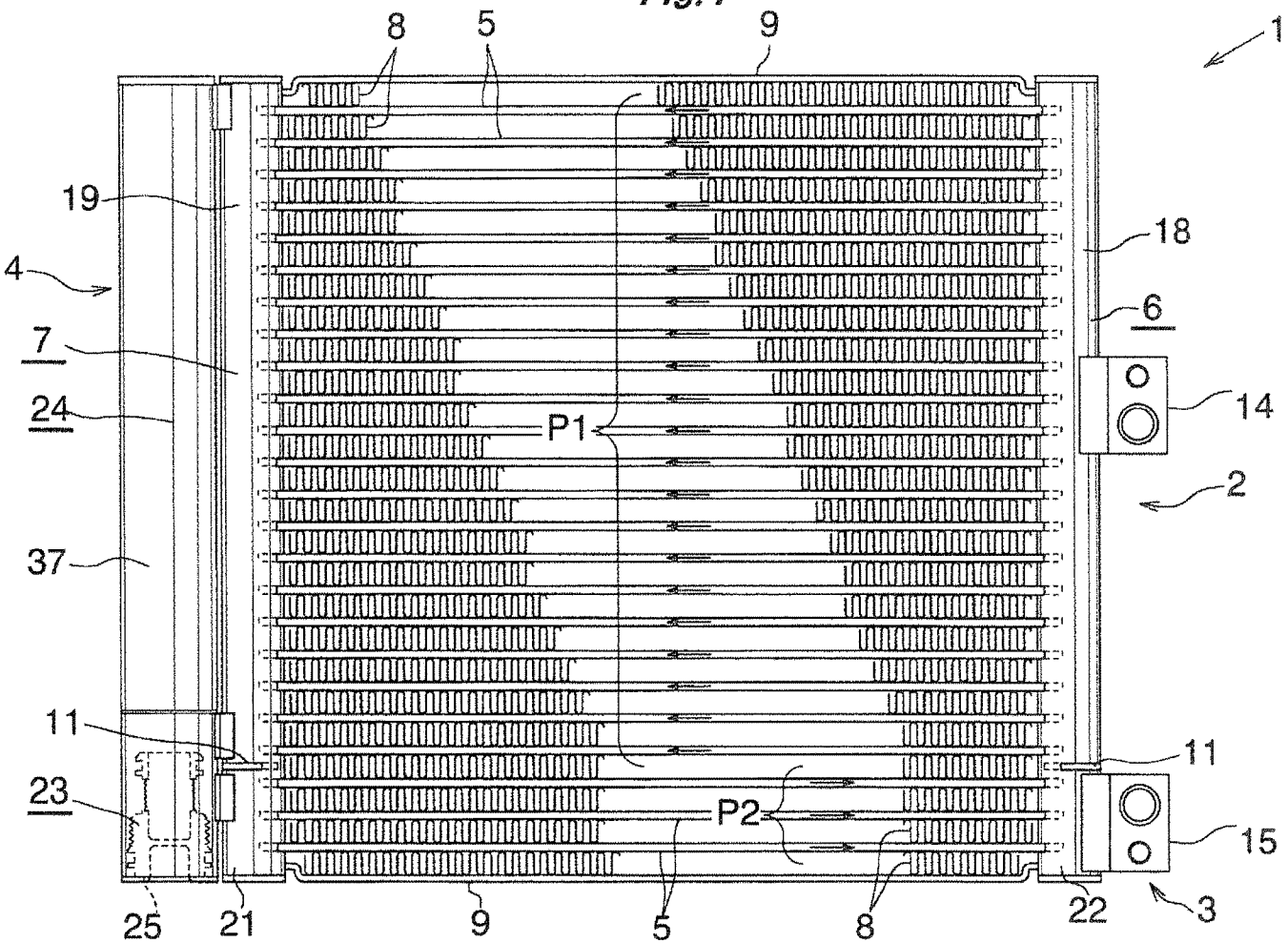
FIG. 1 is a front view specifically showing the overall structure of a condenser in which a liquid receiver of the present invention is used.
Figure 2:
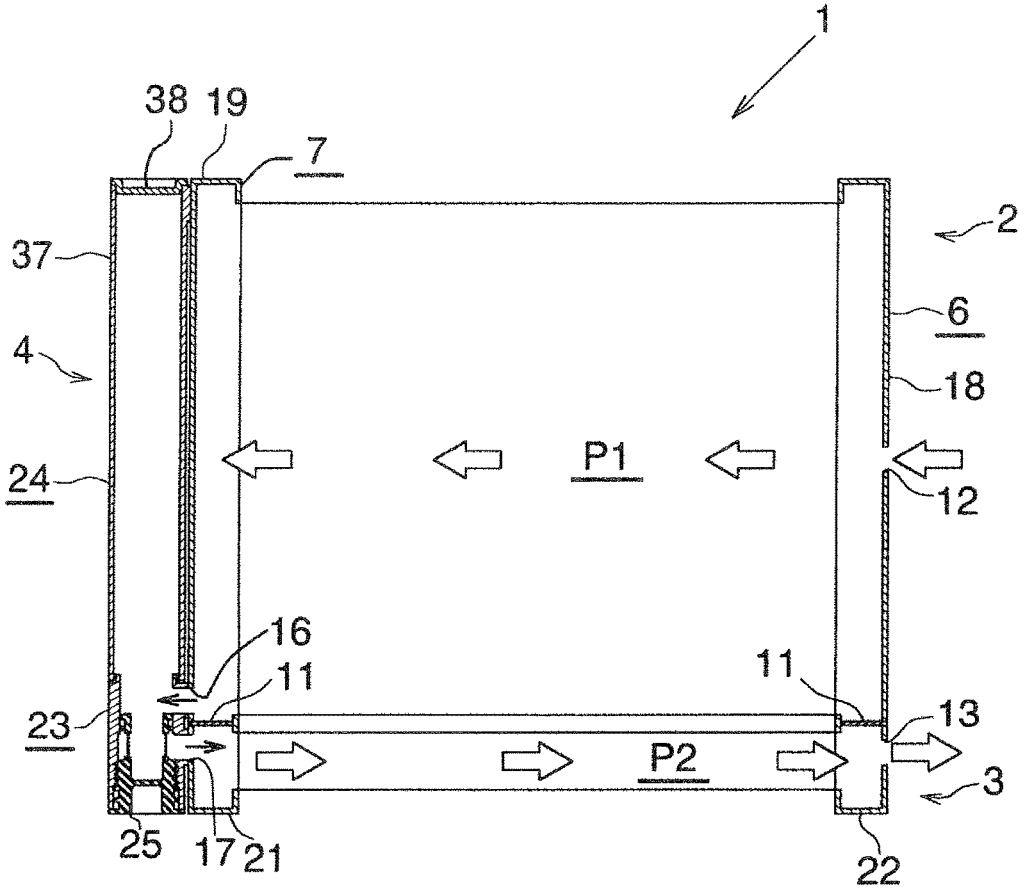
FIG. 2 is a front view schematically showing the condenser of FIG. 1.
Figure 3:
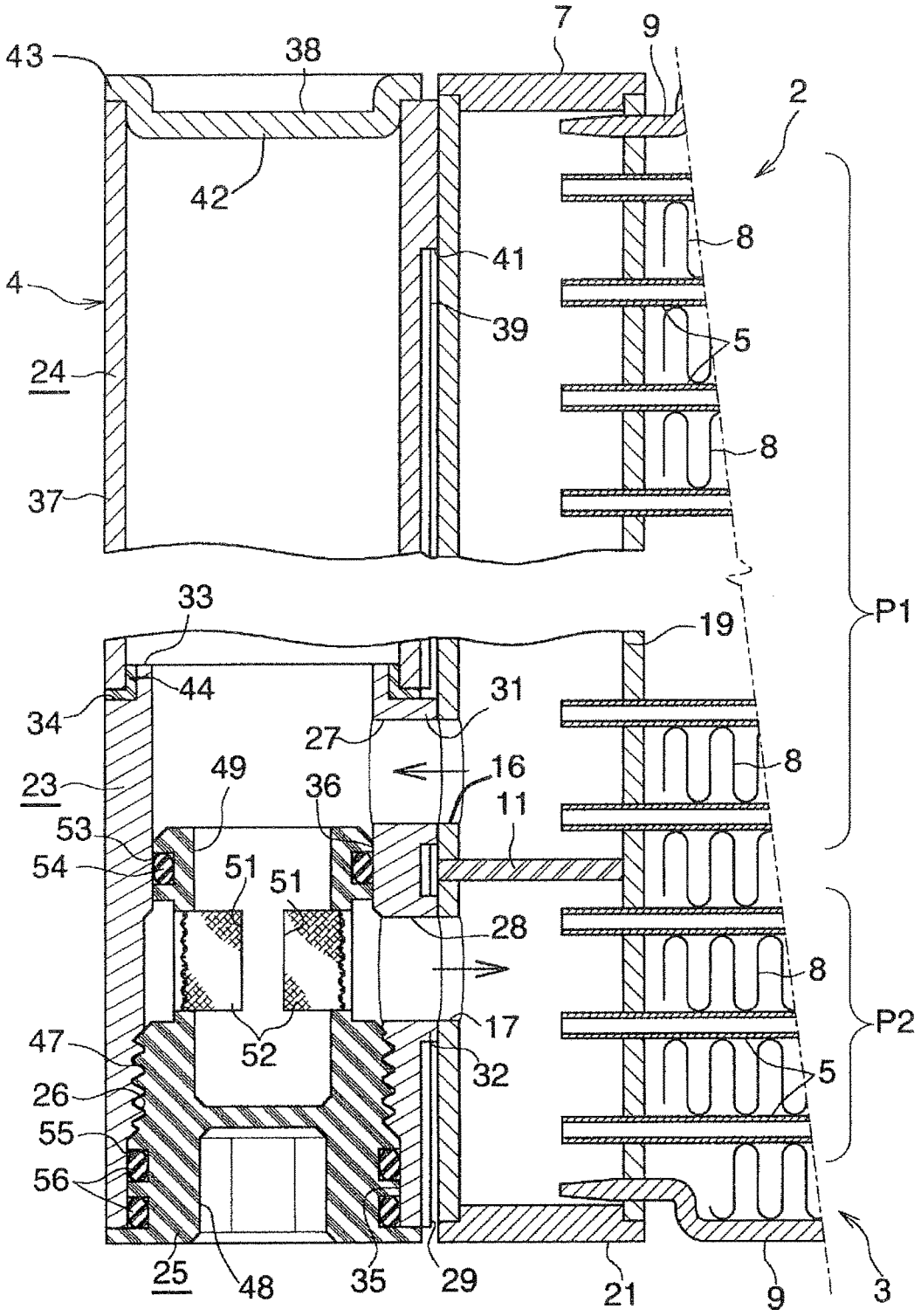
FIG. 3 is a partially cutaway vertical sectional view showing, on an enlarged scale, a left header tank and a liquid receiver of the condenser of FIG. 1 from the front side.
Figure 4:
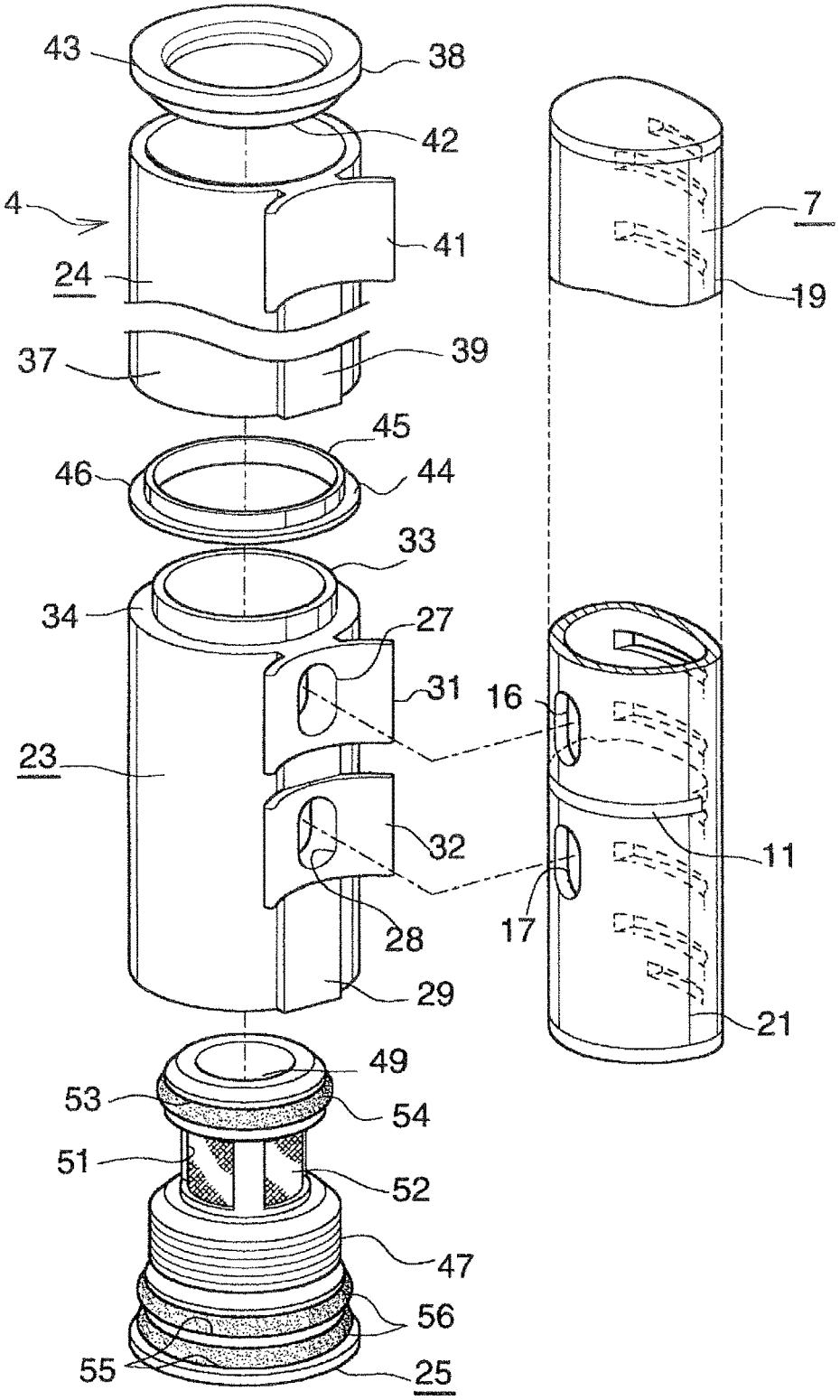
FIG. 4 is a partially cutaway exploded view showing the left header tank and the liquid receiver of the condenser of FIG. 1.

FIG. 1 specifically shows the overall structure of a condenser in which a liquid receiver of the present invention is used. FIG. 2 schematically shows the condenser of FIG. 1. FIGS. 3 and 4 show the structure of a main portion of the condenser of FIG. 1. In FIG. 2, individual heat exchange tubes are not illustrated, and corrugate fins, side plates, a refrigerant inlet member, and a refrigerant outlet member are also not illustrated.

In FIGS. 1 and 2, a condenser 1 is composed of a condensation section 2; a supercooling section 3 provided below the condensation section 2; and a tank-like liquid receiver 4 which is formed of aluminum and is provided between the condensation section 2 and the supercooling section 3 such that the longitudinal direction of the liquid receiver 4 coincides with the vertical direction. The liquid receiver 4 separates gas-liquid-mixed-phase refrigerant produced as a result of condensation at the condensation section 2 into gas-phase refrigerant and liquid-phase refrigerant, stores the liquid-phase refrigerant, and supplies the liquid-phase refrigerant to the supercooling section 3. The condenser 1 constitutes a refrigeration cycle in cooperation with a compressor, an expansion valve (pressure reducer), and an evaporator; and the refrigeration cycle is mounted on a vehicle as a car air conditioner.

The condenser 1 includes a plurality of flat heat exchange tubes 5 formed of aluminum, two header tanks 6 and 7 formed of aluminum, corrugate fins 8 formed of aluminum, and side plates 9 formed of aluminum. The heat exchange tubes 5 are disposed such that their width direction coincides with an air-passing direction, their longitudinal direction coincides with the left-right direction, and they are spaced from one another in the vertical direction. The header tanks 6 and 7 are disposed such that their longitudinal direction coincides with the vertical direction and they are spaced from each other in the left-right direction, and left and right end portions of the heat exchange tubes 5 are connected to the header tanks 6 and 7. Each of the corrugate fins 8 is disposed between and brazed to adjacent heat exchange tubes 5, or is disposed on the outer side of the uppermost or lowermost heat exchange tube 5 and joined to the corresponding heat exchange tube 5 through use of a brazing material. The side plates 9 are disposed on the corresponding outer sides of the uppermost and lowermost corrugate fins 8, and are joined to these corrugate fins 8 through use of a brazing material. In the following description, joining through use of a brazing material will also referred to as "brazing."

Each of the condensation section 2 and the supercooling section 3 of the condenser 1 includes at least one heat exchange path (in the present embodiment, one heat exchange path P1, P2) formed by a plurality of heat exchange tubes 5 successively arranged in the vertical direction. The heat exchange path P1 provided in the condensation section 2 serves as a refrigerant condensation path. The heat exchange path P2 provided in the supercooling section 3 serves as a refrigerant supercooling path. The flow direction of refrigerant is the same among all the heat exchange tubes 5 which form each heat exchange path P1, P2. The flow direction of refrigerant in the heat exchange tubes 5 which form a certain heat exchange path is opposite the flow direction of refrigerant in the heat exchange tubes 5 which form another heat exchange path adjacent to the certain heat exchange path. The heat exchange path P1 of the condensation section 2 will be referred to as the first heat exchange path, and the heat exchange path P2 of the supercooling section 3 will be referred to as the second heat exchange path. In the present embodiment, one heat exchange path is provided in each of the condensation section 2 and the supercooling section 3; however, the number of heat exchange paths is not limited thereto and may be changed freely, provided that the downstream (in the refrigerant flow direction) ends of the heat exchange tubes 5 of the heat exchange path located furthest downstream in the refrigerant flow direction in the condensation section 2 and the upstream (in the refrigerant flow direction) ends of the heat exchange tubes 5 of the heat exchange path located furthest upstream in the refrigerant flow direction in the supercooling section 3 are located on the same side; i.e., are located on the left side or the right side. In the present embodiment, since the single heat exchange path P1 is provided in the condensation section 2, the first heat exchange path P1 serves as a heat exchange path located furthest upstream in the refrigerant flow direction in the condensation section 2 and also serves as a heat exchange path located furthest downstream in the refrigerant flow direction in the condensation section 2. Similarly, since the single heat exchange path P2 is provided in the supercooling section 3, the second heat exchange path P2 serves as a heat exchange path located furthest upstream in the refrigerant flow direction in the supercooling section 3 and also serves as a heat exchange path located furthest downstream in the refrigerant flow direction in the supercooling section 3.

The header tanks 6 and 7 have respective partition members 11 which are formed of aluminum and are provided at the same vertical position on the lower side between the first heat exchange path P1 and the second heat exchange path P2 so as to divide the interior spaces of the header tanks 6 and 7 into upper and lower spaces. A portion of the condenser 1 located on the upper side of the two partition members 11 is the condensation section 2, and a portion of the condenser 1 located on the lower side of the two partition members 11 is the supercooling section 3.

The right header tank 6 has a refrigerant inlet 12 formed in a portion of the circumferential wall thereof located above the corresponding partition member 11, and gas-phase refrigerant compressed by the compressor flows into the refrigerant inlet 12. The right header tank 6 has a refrigerant outlet 13 formed in a portion of the circumferential wall thereof located below the corresponding partition member 11, and liquid-phase refrigerant flows out through the refrigerant outlet 13 toward the expansion valve. A refrigerant inlet member 14 formed of aluminum and having an internal passage communicating with the refrigerant inlet 12 and a refrigerant outlet member 15 formed of aluminum and having an internal passage communicating with the refrigerant outlet 13 are brazed to the right header tank 6. The left header tank 7 has a refrigerant outlet 16 formed in a portion of the circumferential wall thereof located above the corresponding partition member 11, and gas-liquid-mixed-phase refrigerant flows into the liquid receiver 4 through the refrigerant outlet 16. The left header tank 7 has a refrigerant inlet 17 formed in a portion of the circumferential wall thereof located below the corresponding partition member 11, and liquid-phase refrigerant flows into the supercooling section 3 through the refrigerant inlet 17. Therefore, the space of the right header tank 6 located above the corresponding partition member 11 serves as a condensation section inlet header 18, the space of the left header tank 7 located above the corresponding partition member 11 serves as a condensation section outlet header 19, the space of the left header tank 7 located below the corresponding partition member 11 serves as a supercooling section inlet header 21, and the space of the right header tank 6 located below the corresponding partition member 11 serves as a supercooling section outlet header 22.

As shown in FIGS. 3 and 4, the liquid receiver 4 is composed of a base member 23 whose longitudinal direction coincides with the vertical direction and which is brazed to the left header tank 7; a tank member 24 whose longitudinal direction coincides with the vertical direction and which is fixed to the base member 23; and a plug 25 whose longitudinal direction coincides with the vertical direction and which is removably attached to the base member 23. The base member 23 is a cylindrical tubular member which is open at its lower end (first longitudinal end) and at its upper end (second longitudinal end). The tank member 24 is a cylindrical tubular member which is open at its lower end (first longitudinal end) and is closed at its upper end (second longitudinal end). The lower end of the tank member 24 is fixed to the upper end of the base member 23, and the internal space of the tank member 24 communicates with the internal space of the base member 23. The plug 25 is removably inserted into the base member 23 from the lower end side of the base member 23. The lower end (first longitudinal end) of the plug 25 is located near the lower end of the base member 23, and the upper end (second longitudinal end) of the plug 25 is located between the upper and lower ends of the base member 23.

The base member 23 is formed of aluminum bare material such as aluminum extrudate. The base member 23 has a female screw 26 which is formed in a vertically intermediate region of the inner circumferential surface thereof (in the present embodiment, in a region of the inner circumferential surface located slightly below the center thereof in the vertical direction). In a portion of the base member 23 located above the female screw 26, a refrigerant inflow hole 27 communicating with the refrigerant outlet 16 of the condensation section outlet header 19 and a refrigerant outflow hole 28 communicating with the refrigerant inlet 17 of the supercooling section inlet header 21 are formed at a predetermined interval in the vertical direction such that the refrigerant inflow hole 27 is located above the refrigerant outflow hole 28.

The base member 23 has an elongated protrusion 29 integrally formed on its outer circumferential surface so as to extend partially in the circumferential direction and extend over the entire length of the base member 23 in the vertical direction. The elongated protrusion 29 protrudes radially outward, and its protrusion end has a flat surface. Fixing lugs 31 and 32 are integrally provided on the protrusion 29 at vertical positions corresponding to the refrigerant inflow hole 27 and the refrigerant outflow hole 28. The fixing lugs 31 and 32 have arcuate close contact surfaces which come into close contact with the outer surface of the left header tank 7 of the condenser 1. The opposite ends of the refrigerant inflow hole 27 are open to the inner circumferential surface of the base member 23 and the close contact surface of the upper fixing lug 31, and the opposite ends of the refrigerant outflow hole 28 are open to the inner circumferential surface of the base member 23 and the close contact surface of the lower fixing lug 32. The outlines of the cross sections of portions of the base member 23 where the two fixing lugs 31 and 32 are provided have the same shape. The upper fixing lug 31 is brazed to the outer surface of the left header tank 7 such that the refrigerant inflow hole 27 coincides with the refrigerant outlet 16 of the condensation section outlet header 19, and the lower fixing lug 32 is brazed to the outer surface of the left header tank 7 such that the refrigerant outflow hole 28 coincides with the refrigerant inlet 17 of the supercooling section inlet header 21.

A cylindrical tubular insertion portion 33 having a reduced diameter is provided at the upper end of the base member 23 via a step portion 34. Further, a cylindrical lower seal surface 35 whose diameter is larger than the root diameter of the female screw 26 is provided in a region of the inner circumferential surface of the base member 23, which region is located below the female screw 26, and a cylindrical upper seal surface 36 whose diameter is smaller than the inner diameter of the female screw 26 is provided in another region of the inner circumferential surface of the base member 23, which region is located above the female screw 26. The base member 23 is formed by performing cutting and threading on an extrudate having the same shape as the outline of the cross section of the portions where the two fixing lugs 31 and 32 are provided.

The tank member 24 is composed of a cylindrical body 37 which is formed of aluminum bare material such as aluminum extrudate, whose longitudinal direction coincides with the vertical direction, and which is open at its upper and lower ends; and a closing member 38 which is formed of an aluminum brazing sheet having brazing material layers on opposite sides thereof and which is brazed to the upper end of the cylindrical body 37 so as to close the upper end opening.

The cylindrical body 37 of the tank member 24 has an elongated protrusion 39 integrally formed on the outer circumferential surface of the cylindrical body 37 so as to extend partially in the circumferential direction and extend over the entire length of the cylindrical body 37 in the vertical direction. The elongated protrusion 39 protrudes radially outward, and its protrusion end has a flat surface. A spacer portion 41 is integrally provided at the upper end of the elongated protrusion 39. The spacer portion 41 has an arcuate close contact surface which comes into close contact with the outer surface of the left header tank 7 of the condenser 1. The outline of the cross section of a portion of the cylindrical body 37 where the spacer portion 41 is not provided has the same shape as the outline of the cross section of a portion of the base member 23 where the two fixing lugs 31 and 32 are not provided. Also, the outline of the cross section of the portion of the cylindrical body 37 where the spacer portion 41 is provided has the same shape as the outline of the cross section of the portions of the base member 23 where the two fixing lugs 31 and 32 are provided. The inner diameter of the cylindrical body 37 is larger than the outer diameter of the insertion portion 33 of the base member 23. The spacer portion 41 is brazed to the outer surface of the left header tank 7. The cylindrical body 37 is formed by performing cutting on an extrudate having the same shape as the outline of the cross section of the portion of the cylindrical body 37 where the spacer portion 41 is provided.

The closing member 38 of the tank member 24 is formed by performing press working on an aluminum brazing sheet and has a fitting portion 42 which is fitted into the cylindrical body 37 and an outward flange 43 integrally provided at the upper end of the circumferential wall of the fitting portion 42. The circumferential wall of the fitting portion 42 serves as a contact portion which comes into contact with the inner circumferential surface of the cylindrical body 37 and is brazed to the inner circumferential surface of the cylindrical body 37. The outward flange 43 serves as a contact portion which comes into contact with the upper end surface of the cylindrical body 37 and is brazed to the upper end surface of the cylindrical body 37.

The base member 23 and the cylindrical body 37 of the tank member 24 are joined together with a connection ring 44 intervening therebetween. The connection ring 44 is formed by performing press working on an aluminum brazing sheet and has a short cylindrical portion 45 which is present between the outer circumferential surface of the insertion portion 33 of the base member 23 and the inner circumferential surface of the cylindrical body 37 and an outward flange 46 which is integrally provided at the lower end of the short cylindrical portion 45 and is present between the step portion 34 of the base member 23 and the lower end surface of the cylindrical body 37. The short cylindrical portion 45 of the connection ring 44 is brazed to the outer circumferential surface of the insertion portion 33 of the base member 23 and the inner circumferential surface of the cylindrical body 37, and the outward flange 46 is brazed to the step portion 34 of the base member 23 and the lower end surface of the cylindrical body 37, whereby the base member 23 and the cylindrical body 37 of the tank member 24 are joined together with the connection ring 44 intervening therebetween.

The plug 25 is formed of a synthetic resin and has a circular columnar shape. The plug 25 has a male screw 47 formed in a vertically intermediate region of the cylindrical outer circumferential surface of the plug 25 to be located below the refrigerant outflow hole 28. The male screw 47 is brought into screw engagement with the female screw 26 of the base member 23, whereby the plug 25 is removably fitted into the base member 23. The upper end of the plug 25 is located at a vertical position between the refrigerant inflow hole 27 and the refrigerant outflow hole 28. The plug 25 has a bottomed tool hole 48 which extends upward from the lower end surface of the plug 25 and into which a tool for rotating the plug 25 is inserted.

The plug 25 has a bottomed hole 49 which extends downward from the upper end surface thereof and whose lower end is located below the refrigerant outflow hole 28. The plug 25 has a plurality of communication holes 51 which are formed in the circumferential wall of the bottomed hole 49 at predetermined intervals in the circumferential direction, and a filter 52 for removing foreign substances is fixed to the plug 25 such that the filter 52 covers the communication holes 51. At least a portion of each communication hole 51 in the vertical direction is located within the range of the refrigerant outflow hole 28 in the vertical direction. One annular O-ring groove 53 is formed in a region of the outer circumferential surface of the plug 25, which region is located above the communication holes 51, and an O-ring 54 (seal member) fitted into the O-ring groove 53 establishes sealing between the upper seal surface 36 of the base member 23 and the outer circumferential surface of the plug 25. Further, two annular O-ring grooves 55 are formed in a region of the outer circumferential surface of the plug 25, which region is located below the male screw 47, such that the two annular O-ring grooves 55 are spaced from each other in the vertical direction, and O-rings 56 (seal members) fitted into the O-ring groove 55 establish sealing between the lower seal surface 35 of the base member 23 and the outer circumferential surface of the plug 25.

Although not illustrated, a desiccant bag is disposed in a region of the interior of the liquid receiver, which region is located above the plug 25, such that the longitudinal direction of the desiccant bag coincides with the vertical direction. The desiccant bag has gas permeability and liquid permeability and which stores a desiccant.

In a car air conditioner including the condenser 1 having the above-described structure, gas-phase refrigerant of high temperature and high pressure compressed by the compressor flows into the condensation section inlet header 18 of the right header tank 6 through the refrigerant inlet member 14 and the refrigerant inlet 12. The refrigerant is condensed while flowing leftward within the heat exchange tubes 5 of the first heat exchange path P1 and flows into the condensation section outlet header 19 of the left header tank 7. The refrigerant having flowed into the condensation section outlet header 19 of the left header tank 7 passes through the header side refrigerant outlet 16 and the refrigerant inflow hole 27 and enters the liquid receiver 4.

Since the refrigerant having flowed into the liquid receiver 4 is gas-liquid-mixed-phase refrigerant, liquid-phase refrigerant which is a portion of the gas-liquid-mixed-phase refrigerant accumulates in a lower portion of the interior space of the liquid receiver 4 due to the gravitational force, and gas-phase refrigerant which is a portion of the gas-liquid-mixed-phase refrigerant accumulates in an upper portion of the interior space of the liquid receiver 4. The liquid-phase refrigerant enters the bottomed hole 49 of the plug 25, passes through the filter 52, and enters the supercooling section inlet header 21 of the left header tank 7 through the refrigerant outflow hole 28 and the refrigerant inlet 17.

The refrigerant having entered the supercooling section inlet header 21 of the left header tank 7 is super-cooled while flowing rightward within the heat exchange tubes 5 of the second heat exchange path P2, and enters the supercooling section outlet header 22 of the right header tank 6. Subsequently, the super-cooled refrigerant flows out through the refrigerant outlet 13 and the refrigerant outlet member 15, and is then fed to the evaporator through the expansion valve.

When the car air conditioner using the above-described condenser is charged with refrigerant, a portion of the internal space of the liquid receiver 4, which portion is located below the refrigerant inflow hole 27, is filled with liquid-phase refrigerant within a relatively short period of time. As a result, in an early stage, the refrigerant charge amount of the refrigerating cycle can reach a proper charge amount at which the degree of supercooling becomes constant. In addition, the internal volume of a portion of the internal space of the liquid receiver 4, which portion is located above the refrigerant inflow hole 27, is relatively large. Therefore, the width of a stable range within which the degree of supercooling becomes constant; i.e., the width of the range of the refrigerant charge amount within which the degree of supercooling becomes constant, increases. As a result, supercooling characteristics which are more stable against load fluctuation and leakage of refrigerant are obtained.

The present invention comprises the following modes.

1) A liquid receiver for receiving gas-liquid-mixed-phase refrigerant flowing from a condensation section of a condenser and separating the gas-liquid-mixed-phase refrigerant into gas-phase refrigerant and liquid-phase refrigerant, comprising:

a tubular base member which has a longitudinal direction, which is open at a first end on one side in the longitudinal direction and at a second end on the other side in the longitudinal direction, and which is joined to a header tank of the condenser;

a tubular tank member which has a longitudinal direction coinciding with the longitudinal direction of the base member, which is open at a first end on one side in the longitudinal direction of the tank member and is closed at a second end on the other side in the longitudinal direction of the tank member, and whose first end is fixed to the second end of the base member;

a plug which has a longitudinal direction coinciding with the longitudinal direction of the base member, which is removably fitted into the base member from the first end side of the base member, and which has a first end on the first end side of the base member and a second end on the second end side of the base member, wherein a female screw is provided in a region of an inner circumferential surface of the base member, the region being located between the first end and the second end of the base member;

a refrigerant inflow hole and a refrigerant outflow hole are formed in a portion of the base member, which portion is located on the second end side with respect to the female screw, to be separated from each other such that the refrigerant inflow hole is located on the second end side and the refrigerant outflow hole is located on the first end side;

a male screw is provided in a longitudinally intermediate region of an outer circumferential surface of the plug to be located on the first end side with respect to the refrigerant outflow hole;

the male screw is screwed into the female screw of the base member; and at a portion of the base member on the first end side with respect to the female screw, a seal member is provided so as to establish sealing between the inner circumferential surface of the base member and the outer circumferential surface of the plug.

2) The liquid receiver described in par. 1), wherein a distance between the first end of the base member and an end of the refrigerant inflow hole on the second end side of the base member is less than 60 mm.

3) The liquid receiver described in par. 1), wherein the second end of the plug is located between the refrigerant inflow hole and the refrigerant outflow hole; the plug has a bottomed hole which extends from its end surface on the second end side toward the first end side and whose bottom is located on the first end side with respect to the refrigerant outflow hole; a communication hole is formed in a circumferential wall of the bottomed hole of the plug; a filter for removing foreign substances is fixed to the plug such that the filter covers the communication hole; and a seal member for establishing sealing is provided between a region of the inner circumferential surface of the base member between the refrigerant inflow hole and the refrigerant outflow hole and a region of the outer circumferential surface of the plug, which region is located on the second end side with respect to the communication hole.

4) The liquid receiver described in par. 1), wherein the base member has a cylindrical tubular shape; a protrusion protruding radially outward is provided on the outer circumferential surface of the base member such that the protrusion extends in a portion of the outer circumferential surface in a circumferential direction and extends over the entire length of the base member in the longitudinal direction; fixing lugs having arcuate close contact surfaces which come into close contact with an outer surface of the header tank of the condenser are provided on the protrusion at positions corresponding to the refrigerant inflow hole and the refrigerant outflow hole; and opposite ends of the refrigerant inflow hole and the refrigerant outflow hole are open to the inner circumferential surface of the base member and the close contact surfaces of the fixing lugs, respectively, wherein the tank member is composed of a cylindrical body which is open at the first end and the second end, and a closing member which is joined to the second end of the cylindrical body and which closes an opening of the cylindrical body on the second end side; and a protrusion protruding radially outward is provided on the outer circumferential surface of the cylindrical body such that the protrusion extends in a portion of the outer circumferential surface in a circumferential direction and extends over the entire length of the cylindrical body in the longitudinal direction, wherein a cross section of a portion of the base member where the fixing lugs are not provided has the same outline as a cross section of the cylindrical body of the tank member.

5) The liquid receiver described in par. 4), wherein the base member is formed of a bare material; a cylindrical tubular insertion portion whose outer diameter is smaller than an inner diameter of the cylindrical body of the tank member and which is inserted into the cylindrical body is provided at the second end of the base member with a step portion intervening therebetween; and a connection ring is disposed between the base member and the cylindrical body of the tank member, the connection ring having a short cylindrical portion which is present between an outer circumferential surface of the insertion portion of the base member and an inner circumferential surface of the cylindrical body, and an outward flange which is integrally provided at an end of the short cylindrical portion on the side toward the first end of the tank member and is present between the step portion of the base member and an end surface of the cylindrical body; and the short cylindrical portion and the outward flange of the connection ring are joined to the base member and the cylindrical body through use of a brazing material.

6) The liquid receiver described in par. 4), wherein a spacer portion having an arcuate close contact surface which comes into close contact with an outer surface of the header tank of the condenser to which the base member is joined is provided at an end of the protrusion of the cylindrical body of the tank member, the end being located on the second end side of the tank member; and a cross section of a portion of the cylindrical body of the tank member where the spacer portion is provided has the same outline as a cross section of a portion of the base member where the fixing lugs are provided.

7) A condenser comprising a condensation section; a supercooling section provided below the condensation section; and a liquid receiver which is provided between the condensation section and the supercooling section and which receives gas-liquid-mixed-phase refrigerant from the condensation section and separates the gas-liquid-mixed-phase refrigerant into gas-phase refrigerant and liquid-phase refrigerant, wherein the condensation section includes a condensation section outlet header whose longitudinal direction coincides with a vertical direction, and a heat exchange path formed by a plurality of heat exchange tubes which are disposed in parallel such that their longitudinal direction coincides with a left-right direction and they are spaced from one another in the vertical direction and each of which is connected, at one end in the longitudinal direction, to the condensation section outlet header; the supercooling section includes a supercooling section inlet header disposed on the lower side and adjacent to the condensation section outlet header, and a heat exchange path formed by a plurality of heat exchange tubes which are disposed in parallel such that their longitudinal direction coincides with the left-right direction and they are spaced from one another in the vertical direction and each of which is connected, at one end in the longitudinal direction, to the supercooling section inlet header; and the liquid receiver is composed of the liquid receiver described in par. 1), wherein the condensation section outlet header and the supercooling section inlet header are provided in a single header tank; the condensation section outlet header has a refrigerant outlet through which the refrigerant flows out from the condensation section; and the supercooling section has a refrigerant inlet into which the refrigerant flows from liquid receiver, wherein the base member is joined to the header tank in a state in which the refrigerant inflow hole of the base member of the liquid receiver communicates with the refrigerant outlet of the condensation section outlet header and the refrigerant outflow hole communicates with the refrigerant inlet of the supercooling section inlet header.

8) A condenser comprising a condensation section; a supercooling section provided below the condensation section;

and a liquid receiver which is provided between the condensation section and the supercooling section and which receives gas-liquid-mixed-phase refrigerant from the condensation section and separates the gas-liquid-mixed-phase refrigerant into gas-phase refrigerant and liquid-phase refrigerant, wherein the condensation section includes a condensation section outlet header whose longitudinal direction coincides with a vertical direction, and a heat exchange path formed by a plurality of heat exchange tubes which are disposed in parallel such that their longitudinal direction coincides with a left-right direction and they are spaced from one another in the vertical direction and each of which is connected, at one end in the longitudinal direction, to the condensation section outlet header; the supercooling section includes a supercooling section inlet header disposed on the lower side and adjacent to the condensation section outlet header, and a heat exchange path formed by a plurality of heat exchange tubes which are disposed in parallel such that their longitudinal direction coincides with the left-right direction and they are spaced from one another in the vertical direction and each of which is connected, at one end in the longitudinal direction, to the supercooling section inlet header; and the liquid receiver is composed of the liquid receiver described in par. 6), wherein the condensation section outlet header and the supercooling section inlet header are provided in a single header tank; the condensation section outlet header has a refrigerant outlet through which the refrigerant flows out from the condensation section; and the supercooling section has a refrigerant inlet into which the refrigerant flows from liquid receiver, wherein the close contact surface of one fixing lug of the base member of the liquid receiver is brought into close contact with an outer surface of the header tank such that the refrigerant inflow hole communicates with the refrigerant outlet of the condensation section outlet header, the close contact surface of the other fixing lug is brought into close contact with the outer surface of the header tank such that the refrigerant outflow hole communicates with the refrigerant inlet of the supercooling section inlet header, and in this state, the two fixing lugs are joined to the header tank through use of a brazing material; and the spacer portion of the cylindrical body of the tank member of the liquid receiver is brought into close contact with the outer surface of the header tank and is brazed to the header tank through use of a brazing material.

In the liquid receiver of any one of pars. 1) to 6), a female screw is provided in a region of the inner circumferential surface of the base member, the region being located between the first end and the second end of the base member; and a refrigerant inflow hole and a refrigerant outflow hole are formed in a portion of the base member, which portion is located on the second end side with respect to the female screw, to be separated from each other such that the refrigerant inflow hole is located on the second end side and the refrigerant outflow hole is located on the first end side. Therefore, the distance from the first end of the base member to the end of the refrigerant inflow hole on the side toward the second end of the base member in the liquid receiver can be made relatively short. Accordingly, when a refrigerating cycle including a condenser having this liquid receiver is charged with refrigerant, a portion of the internal space of the liquid receiver, which portion is located on the side toward the first end of the base member with respect to the refrigerant inflow hole, is filled with liquid-phase refrigerant within a relatively short period of time. As a result, in an early stage, the refrigerant charge amount of the refrigerating cycle can reach a proper charge amount at which the degree of supercooling becomes constant. In addition, the internal volume of a portion of the internal space of the liquid receiver, which portion is located on the side toward the second end of the base member with respect to the refrigerant inflow hole, is relatively large. Therefore, the width of a stable range within which the degree of supercooling becomes constant; i.e., the width of the range of the refrigerant charge amount within which the degree of supercooling becomes constant, increases. As a result, supercooling characteristics which are more stable against load fluctuation and leakage of refrigerant are obtained.

Also, since the thicknesses of the base member and the tank member can be set to proper thicknesses suitable for their functions, weight reduction and cost reduction become possible. For example, the thickness of the base member can be minimized within a thickness range which allows formation of the female screw, and the thickness of the tank member can be minimized within a thickness range which allows the tank member to have a required strength against pressure.

Further, since the refrigerant inflow hole and the refrigerant outflow hole are formed in the base member, positional discrepancy between the two holes can be prevented. In the case of the liquid receiver disclosed in the above-mentioned publication, the refrigerant inflow hole into which refrigerant flows from the condensation section of the condenser is formed in the body portion, and the refrigerant outflow hole from which refrigerant flows to the supercooling section of the condenser is formed in the female screw forming portion. Therefore, when the body portion and the female screw forming portion are combined, positional discrepancy may occur between the two holes.

According to the liquid receiver of par. 2), when a refrigerating cycle including a condenser having this liquid receiver is charged with refrigerant, it is possible to effectively shorten the time required for the liquid-phase refrigerant to fill the portion of the internal space of the liquid receiver, which portion is located on the side toward the first end of the base member with respect to the refrigerant inflow hole. In addition, the size and weight of the base member can be reduced.

According to the liquid receiver of par. 3), the refrigerant having flowed into the liquid receiver through the refrigerant inflow hole passes through the filter without fail. Therefore, it is possible to reliably prevent the liquid-phase refrigerant flowing from the interior of the liquid receiver into the supercooling section inlet header from containing foreign substances.

According to the liquid receiver of par. 4), the base member can be manufactured by cutting a blank formed of, for example, extrudate, into a predetermined length and performing machining or the like for portions to be machined, and the cylindrical body of the tank member can be manufactured by cutting a blank formed of, for example, extrudate, into a predetermined length. Therefore, work for manufacturing these members becomes relatively simple.

According to the condenser of par. 7), when a refrigerating cycle including a condenser having this liquid receiver is charged with refrigerant, a portion of the internal space of the liquid receiver, which portion is located on the side toward the first end of the base member with respect to the refrigerant inflow hole, is filled with liquid-phase refrigerant within a relatively short period of time. As a result, in an early stage, the refrigerant charge amount of the refrigerating cycle can reach a proper charge amount at which the degree of supercooling becomes constant. In addition, the internal volume of a portion of the internal space of the liquid receiver, which portion is located on the side toward the second end of the base member with respect to the refrigerant inflow hole, is relatively large. Therefore, the width of a stable range within which the degree of supercooling becomes constant; i.e., the width of the range of the refrigerant charge amount within which the degree of supercooling becomes constant, increases. As a result, supercooling characteristics which are more stable against load fluctuation and leakage of refrigerant are obtained.

According to the condenser of par. 8), when the member constituting the header tank of the condenser, the closing member of the tank member of the liquid receiver, and the connection ring are each formed of a brazing sheet having brazing material layers on opposite sides thereof, all the metallic components of the condenser and all the components of the liquid receiver, excluding the plug and the seal members, can be brazed together in a furnace. Therefore, work for manufacturing the condenser becomes simple. In addition, by the actions of the two fixing lugs and the spacer portion, the predetermined postures of the base member and the cylindrical body of the tank member can be maintained during the brazing in the furnace.

What is claimed is:

1. A liquid receiver connected to a header tank of a condenser, comprising:

a tubular base member comprising:

a base circumferential wall to define a base inner space having a base first opening and a base second opening opposite to the base first opening in a longitudinal direction;

a refrigerant inflow hole which passes through the base circumferential wall and via which the header tank is in communication with the base inner space so that refrigerant flows into the liquid receiver;

a refrigerant outflow hole which passes through the base circumferential wall and via which the header tank is in communication with the base inner space so that the refrigerant flows out of the liquid receiver, the refrigerant outflow hole being provided between the refrigerant inflow hole and the base first opening in the longitudinal direction; and a female screw provided in an inner circumferential surface of the base circumferential wall and between the refrigerant outflow hole and the base first opening in the longitudinal direction;

a tubular tank member comprising:

a tank wall to define a tank inner space having a tank first opening and a tank closed end opposite to the tank first opening in the longitudinal direction, the tank first opening being connected to the base second opening so that the tank inner space is in communication with the base inner space;

a plug comprising:

a plug circumferential wall to define a plug inner space having a plug opening and a closed bottom opposite to the plug opening in the longitudinal direction;

a plug end at an end opposite to the plug opening in the longitudinal direction;

the plug being fitted into the base member along the longitudinal direction from the base first opening so that the plug opening is provided between the refrigerant inflow hole and the refrigerant outflow hole in the longitudinal direction and so that the plug inner space is in communication with the base inner space;

a communication hole which passes through the plug circumferential wall and which is provided between the refrigerant inflow hole and the closed bottom in the longitudinal direction to be aligned with the refrigerant outflow hole; and a male screw provided in an outer circumferential surface of the plug circumferential wall and between the communication hole and the plug end in the longitudinal direction;

a first seal member provided between the inner circumferential surface of the base member and the outer circumferential surface of the plug, between the base first opening and the female screw in the longitudinal direction, and between the plug end and the male screw in the longitudinal direction; and a second seal member provided between the inner circumferential surface of the base member and the outer circumferential surface of the plug, between the refrigerant inflow hole and the refrigerant outflow hole in the longitudinal direction, and between the plug opening and the communication hole in the longitudinal direction.

2. The liquid receiver according to claim 1, wherein a distance between the base first opening and an upper end of the refrigerant inflow hole in the longitudinal direction is less than 60 mm.

3. The liquid receiver according to claim 1, further comprising:

a filter provided at the communication hole to remove foreign substances.

4. The liquid receiver according to claim 1, wherein the base member has a cylindrical tubular shape; a protrusion protruding radially outward is provided on an outer circumferential surface of the base member such that the protrusion extends in a portion of the outer circumferential surface in a circumferential direction and extends over an entire length of the base member in the longitudinal direction; fixing lugs having arcuate close contact surfaces which come into close contact with an outer surface of the header tank of the condenser are provided on the protrusion at positions corresponding to the refrigerant inflow hole and the refrigerant outflow hole; and opposite ends of the refrigerant inflow hole and the refrigerant outflow hole are open to the inner circumferential surface of the base member and the close contact surfaces of the fixing lugs, respectively, wherein the tubular tank member has a cylindrical body which has the tank first opening and a tank second opening opposite to the tank first opening in the longitudinal direction, and a closing member which is joined to the tank second opening of the cylindrical body to close the tank second opening; and a protrusion protruding radially outward is provided on an outer circumferential surface of the cylindrical body such that the protrusion extends in a portion of the outer circumferential surface in a circumferential direction and extends over an entire length of the cylindrical body in the longitudinal direction, wherein a cross section of a portion of the base member where the fixing lugs are not provided has a substantially same outline as a cross section of the cylindrical body of the tank member.

5. The liquid receiver according to claim 4, wherein the base member is formed of a bare material; a cylindrical tubular insertion portion whose outer diameter is smaller than an inner diameter of the cylindrical body of the tank member and which is inserted into the cylindrical body is provided at the base second opening with a step portion intervening therebetween; and a connection ring is disposed between the base member and the cylindrical body of the tank member, the connection ring having a short cylindrical portion which is present between an outer circumferential surface of the insertion portion of the base member and an inner circumferential surface of the cylindrical body, and an outward flange which is integrally provided at an end of the short cylindrical portion on a side toward the tank first opening and is present between the step portion of the base member and an end surface of the cylindrical body; and the short cylindrical portion and the outward flange of the connection ring are joined to the base member and the cylindrical body through use of a brazing material.

6. The liquid receiver according to claim 4, wherein a spacer portion having an arcuate close contact surface which comes into close contact with an outer surface of the header tank of the condenser to which the base member is joined is provided at an end of the protrusion of the cylindrical body of the tank member, the end being located on a side of the tank closed end; and a cross section of a portion of the cylindrical body of the tank member where the spacer portion is provided has a substantially same outline as a cross section of a portion of the base member where the fixing lugs are provided.

7. A condenser comprising a condensation section; a supercooling section provided below the condensation section; and a liquid receiver which is provided between the condensation section and the supercooling section and which receives gas-liquid-mixed-phase refrigerant from the condensation section and separates the gas-liquid-mixed-phase refrigerant into gas-phase refrigerant and liquid-phase refrigerant, wherein the condensation section includes a condensation section outlet header whose longitudinal direction coincides with a vertical direction, and a heat exchange path formed by a plurality of heat exchange tubes which are disposed in parallel such that their longitudinal direction coincides with a left-right direction and they are spaced from one another in the vertical direction and each of which is connected, at one end in the longitudinal direction, to the condensation section outlet header; the supercooling section includes a supercooling section inlet header disposed on the lower side and adjacent to the condensation section outlet header, and a heat exchange path formed by a plurality of heat exchange tubes which are disposed in parallel such that their longitudinal direction coincides with the left-right direction and they are spaced from one another in the vertical direction and each of which is connected, at one end in the longitudinal direction, to the supercooling section inlet header; and the liquid receiver is composed of the liquid receiver according to claim 1, wherein the condensation section outlet header and the supercooling section inlet header are provided in a single header tank; the condensation section outlet header has a refrigerant outlet through which the refrigerant flows out from the condensation section; and the supercooling section has a refrigerant inlet into which the refrigerant flows from liquid receiver, wherein the base member is joined to the header tank in a state in which the refrigerant inflow hole of the base member of the liquid receiver communicates with the refrigerant outlet of the condensation section outlet header and the refrigerant outflow hole communicates with the refrigerant inlet of the supercooling section inlet header.

8. A condenser comprising a condensation section; a supercooling section provided below the condensation section; and a liquid receiver which is provided between the condensation section and the supercooling section and which receives gas-liquid-mixed-phase refrigerant from the condensation section and separates the gas-liquid-mixed-phase refrigerant into gas-phase refrigerant and liquid-phase refrigerant, wherein the condensation section includes a condensation section outlet header whose longitudinal direction coincides with a vertical direction, and a heat exchange path formed by a plurality of heat exchange tubes which are disposed in parallel such that their longitudinal direction coincides with a left-right direction and they are spaced from one another in the vertical direction and each of which is connected, at one end in the longitudinal direction, to the condensation section outlet header; the supercooling section includes a supercooling section inlet header disposed on the lower side and adjacent to the condensation section outlet header, and a heat exchange path formed by a plurality of heat exchange tubes which are disposed in parallel such that their longitudinal direction coincides with the left-right direction and they are spaced from one another in the vertical direction and each of which is connected, at one end in the longitudinal direction, to the supercooling section inlet header; and the liquid receiver is composed of the liquid receiver according to claim 6, wherein the condensation section outlet header and the supercooling section inlet header are provided in a single header tank; the condensation section outlet header has a refrigerant outlet through which the refrigerant flows out from the condensation section; and the supercooling section has a refrigerant inlet into which the refrigerant flows from liquid receiver, wherein the close contact surface of one fixing lug of the base member of the liquid receiver is brought into close contact with an outer surface of the header tank such that the refrigerant inflow hole communicates with the refrigerant outlet of the condensation section outlet header, the close contact surface of the other fixing lug is brought into close contact with the outer surface of the header tank such that the refrigerant outflow hole communicates with the refrigerant inlet of the supercooling section inlet header, and in this state, the two fixing lugs are joined to the header tank through use of a brazing material; and the spacer portion of the cylindrical body of the tank member of the liquid receiver is brought into close contact with the outer surface of the header tank and is brazed to the header tank through use of a brazing material.

* * * * *